US005735185A

United States Patent [19]

Kondo et al.

[11] Patent Number: 5,735,185

[45] Date of Patent: Apr. 7, 1998

[54] ROTARY-TYPE SHEET CUTTER

[75] Inventors: Takajiro Kondo, Yonago; Masato Ashida; Iwao Kashiwagi, both of Yasugi, all of Japan

[73] Assignees: Hitachi Metals, Ltd., Tokyo; Yasugi Seimitsu, Ltd., Yasugi, Japan

[21] Appl. No.: 647,671

[22] Filed: May 15, 1996

Related U.S. Application Data

[63] Continuation of Ser. No. 174,028, Dec. 28, 1993, abandoned.

[30] Foreign Application Priority Data

Dec. 28, 1992 [JP] Japan ..... 4-347816

[51] Int. Cl.[6] ..... B26D 7/26

[52] U.S. Cl. ..... 83/611; 83/673; 83/694

[58] Field of Search ..... 83/341, 349, 564, 83/584, 597, 611, 610, 673, 674, 694

[56] References Cited

U.S. PATENT DOCUMENTS

| | | | |
|---|---|---|---|
| 613,322 | 11/1898 | Schuermann | 83/611 |
| 1,632,378 | 6/1927 | Lerner | 83/349 |
| 1,947,181 | 2/1934 | Behrman | 83/694 |
| 2,495,957 | 1/1950 | Corsaw | 83/611 |
| 2,604,166 | 7/1952 | Turner | 83/611 |
| 2,836,241 | 5/1958 | Fritzinger | 83/611 |
| 2,862,676 | 12/1958 | Castelli | 83/611 |
| 3,522,752 | 8/1970 | Ford | 83/611 |
| 3,898,902 | 8/1975 | Cailloux | 83/611 |
| 3,918,339 | 11/1975 | Cailloux | 83/611 |
| 4,458,570 | 7/1984 | Morrison | 83/611 |
| 4,630,765 | 12/1986 | Samuelson et al. | 83/610 |
| 4,664,006 | 5/1987 | Mitchell | 83/341 |
| 4,667,554 | 5/1987 | Peery | 83/611 |
| 4,974,436 | 12/1990 | Nakatsuji | 83/636 |
| 4,984,490 | 1/1991 | Kurki | 83/349 |

FOREIGN PATENT DOCUMENTS

| | | | |
|---|---|---|---|
| 0557022 | 5/1958 | Canada | 83/611 |
| 1 087 957 | 8/1960 | Germany | 83/348 |
| 57-19279 | 4/1982 | Japan | B26D 1/38 |
| 64-6233 | 2/1989 | Japan | B26D 1/38 |
| 1-121688 | 8/1989 | Japan | B26D 1/38 |
| 2257084 | 1/1993 | United Kingdom . | |

*Primary Examiner*—Maurina T. Rachuba

*Attorney, Agent, or Firm*—Sughrue, Mion, Zinn, Macpeak & Seas, PLLc

[57] ABSTRACT

A rotary-type sheet cutter for cutting a continuous sheet material comprising a stationary blade having an end edge extending along the widthwise direction of the sheet material; and a rotary blade having an end edge which rotates about a rotary axis extending along the widthwise direction of the sheet material during rotation of the rotary blade, the end edge of the rotary blade intersection-contacting with that of the stationary blade under pressure so as to cut the sheet material along the widthwise direction when the rotary blade rotates. The rotary blade is formed by bending a flat plate along a bend line which is brought into a state of extending along the widthwise direction of the sheet material, and the end edge and the bend line are arranged to form an angle opening toward a cutting starting side.

48 Claims, 10 Drawing Sheets

ROTARY-TYPE SHEET CUTTER

This is a continuation of application Ser. No. 08/174,028 filed Dec. 28, 1993 abandoned.

BACKGROUND OF THE INVENTION

The present invention relates to a rotary-type sheet cutter for cutting a sheet material for a facsimile machine or a printer, or for cutting a continuous sheet material such as a recording film, cloth or the like to a desired length.

Conventionally, most sheet cutters used for the various purposes described above are of a shear type comprising a pair of blades. In a rotary-type sheet cutter, one of the blades is a stationary blade, and the other is a rotary blade which is rotated a predetermined angle of one rotation or less than one rotation about the rotary axis. Since the rotary-type sheet cutter has a relatively simple structure and exhibits excellent cutting performance, it is widely used.

In relation to such rotary-type sheet cutters, size reduction, weight reduction and cost reduction have always been required. Cost reductions can be obtained by using a sheet cutter in which only a blade edge section is made from a high-grade steel tip whereas the attachment base portion of the blade is made of an inexpensive material. Also, a sheet cutter may be used in which a plate material is bent into an L-shaped cross-sectional configuration or the like as an attachment base portion without requiring a conventionally shaped support element. Further, there has been suggested a sheet cutter in which a plate material is bent into a member in substantially the same manner as the above-mentioned attachment base portion, and a blade edge is directly formed on the member (JP-U-1-121688). The cutter of the latter type is advantageous in cost reduction because it does not require a separate cutting tip, and the process for securing the tip on an attachment base portion is therefore also eliminated.

In the sheet cutter of the above-mentioned rotary type, a stationary blade and a rotary blade are each supported at opposite ends thereof. The sheet cutters are typically of the twin-bearing type to counteract shear forces when cutting the sheet material. Also, the blades are designed to have an adequate shear angle (an angle defined between the blade edges) so that cutting of the sheet material progresses from one end toward the other with a low cutting reaction force.

Methods for creating the shear angle can be classified into three types, i.e., (1) inclining a rotary axis of the rotary blade relative to the knife edge of the stationary blade, (2) inclining the knife edge of the rotary blade relative to the rotary axis, and (3) adopting both the methods (1) and (2).

In the rotary-type sheet cutter, the two blades are bent due to a cutting reaction force if their rigidity with respect to the shear reaction force is insufficient. In the cutter of the twin-bearing type, this bending decreases the shear angle in the latter half of cutting operation, thereby increasing the cutting reaction force even further. As a result, the cutter becomes incapable of cutting in a worst scenario. In order to decrease cutting torque, reduce the size of the device and so forth, the diameter of a circular locus of the blade edge of the rotary blade is decreased, or the whole rotary blade is enclosed within a range of the minimum radius from the rotary axis, and the rotary blade is formed by bending a plate material. The rotary blade of this type tends to have insufficient rigidity with respect to the shear reaction (as cutting reaction and press-contact reaction are sometimes hereinafter referred to).

In an ordinary rotary-type sheet cutter, a stationary blade is set horizontally because the left and right sides of a sheet material to be cut are kept at the same level while it is fed. When the shear angle is set by the methods (1) and (3) described above, the axis of the rotary blade is inclined relative to the stationary blade, and consequently the cutter has a large height which is disadvantageous when size reduction is desired.

It is very important for the rotary-type sheet cutter to start contact between the cutting edges of the stationary blade and the rotary blade smoothly. Various methods have been proposed in this respect. For example, there are methods (a) in which a guide ring is provided on a rotary blade (JP-Y-1-6233), and (b) in which a blade edge guide plate is provided on a stationary blade (JP-Y-57-19279). In the rotary blade formed by bending a plate material, since the main object is usually cost reduction, it is difficult to employ method (a). Therefore, method (b) is employed, or small chamfered guide portions are formed on extension portions of the edges of the two blades, or the assembly accuracy is enhanced. In any case, however, an impact force at the start of the contact between the two blades is relatively large, and the torque required for driving the cutter is also large, so that the drive system must be capable of exerting a large force.

The conventional rotary blade formed by bending a plate material on which a cutting edge is directly formed or for which a tip is secured by adhesion or other methods involves various drawbacks. For example, a cross-sectional configuration of the rotary blade after being bent, and a position of formation of the cutting edge with respect to the cross-sectional configuration, may be inappropriate, so that the maximum radius of the rotary blade is too large, and so that a space occupied by the rotary blade during the rotation is increased, thereby enlarging the overall size of the cutter. The rigidity of the rotary blade with respect to a shear reaction force may be small, and the plate material to be bent may have a large width, so that the efficiency in bending the plate material is low. The rotary blade may also tend to interrupt free feeding and discharge of a sheet material to be cut. Since the tolerance of the rotary blade relative to assembly errors is low, high accuracy during assembly is required.

An objective of the present invention is to provide a sheet cutter in which a cutting edge is formed directly on a member of the above-mentioned plate material which is bent as a rotary blade, or on a tip member secured on this member, wherein the various drawbacks described above are solved by altering the cross-sectional configuration of the rotary blade and the location of the cutting edge.

SUMMARY OF THE INVENTION

The present invention relates to a rotary-type sheet cutter with a rotary blade formed by bending a plate, and a cutting edge which is formed directly on the member, or on a tip member secured on this member. One objective of the invention is to decrease the space required for the rotary blade. In the first aspect, the rotary blade is designed in such a manner that the rigidity relative to a shear reaction is increased sufficiently, so that the inclination of a rotary axis of the rotary blade can be decreased while the cross-sectional configuration of the rotary blade is maintained within a range of the minimum radius.

According to a second aspect, the invention is designed to realize a smooth start of contact between cutting edges irrespective of slight assembly errors, which method is of primary importance in the case of an ordinary rotary-type sheet cutter. In the second aspect, the rigidity at a cutting starting end portion of the cutting edges in the press-contact direction is decreased, thus realizing a smooth start of contact between the cutting edges.

According to a third aspect, the invention directed to a rotary-type sheet cutter in which features from both the first and second embodiments are combined.

More specifically, according to the first aspect of the invention, the rotary-type sheet cutter for cutting a continuous sheet material comprises:

a stationary blade having an end edge extending along the widthwise direction of the sheet material; and a rotary blade having an end edge which rotates about a rotary axis () extending along the widthwise direction of the sheet material during rotation of the rotary blade, the end edge of the rotary blade intersection-contacting with that of the stationary blade under pressure so as to cut the sheet material along the widthwise direction when the rotary blade rotates, wherein:

the rotary blade is formed by bending a flat plate along a bend line (c) which extends along the widthwise direction of the sheet material, and the end edge (k) of the rotary blade and the bend line (c) form an angle (ø) opening toward a cutting starting side.

According to the second aspect of the invention, the rotary-type sheet cutter for cutting a continuous sheet material comprises:

a stationary blade having an end edge extending along the widthwise direction of the sheet material; and a rotary blade having an end edge which rotates about a rotary axis (O) extending along the widthwise direction of the sheet material during rotation of the rotary blade, the end edge of the rotary blade intersection-contacting with that of the stationary blade under pressure so as to cut the sheet material along the widthwise direction when the rotary blade rotates, wherein:

the rotary blade is formed by bending a flat plate along a bend line (c) which extends along the widthwise direction of the sheet material, and a corner portion of the rotary blade at a cutting starting side is first brought into contact with the stationary blade when the rotary blade rotates.

According to the third aspect of the invention, the rotary-type sheet cutter for cutting a continuous sheet material comprises:

a stationary blade having an end edge extending along the widthwise direction of the sheet material; and a rotary blade having an end edge which rotates about a rotary axis (O) extending along the widthwise direction of the sheet material during rotation of the rotary blade, the end edge of the rotary blade intersection-contacting with that of the stationary blade under pressure so as to cut the sheet material along the widthwise direction when the rotary blade rotates, wherein:

the rotary blade is formed by bending a flat plate along a bend line (c) which extends along the widthwise direction of the sheet material, and the end edge line (k) of the rotary blade and the bend line (c) form an angle (ø) opening toward a cutting starting side, and wherein a corner portion of the rotary blade at a cutting starting side is first brought into contact with the stationary blade when the rotary blade rotates.

Alternatively, in the above sheet cutters, the rotary blade is replaceable with one consisting of a plate section being formed by bending a flat plate along a bend line (c), and a tip plate being fixed on an end portion of the plate section opposite to the bend line (c) and having an end edge (k) of the rotary blade.

It is preferable to use the rotary blade being formed by bending the flat plate toward the side of the expected rotary axis (O) of the rotary blade and along a bend line (c) which is positioned so as to extend along the widthwise direction of the sheet material so that the rotary blade has high rigidity and the sheet cutter may be reduced in size.

It is also preferable to use the rotary blade having a shape in which a rear end edge, opposite to the end edge (k) via the bend line (c), and the bend line (c) are arranged to form an angle (θ) opening toward a cutting finishing side from the cutting starting side so that the rotary blade does not interfere with the sheet material.

Alternatively, a similar effect can be attained by using a rotary blade being formed by bending a flat plate toward the opposite side of the expected rotary axis (O) of the rotary blade and along a bend line (c) which is positioned so as to extend along the widthwise direction of the sheet material.

DETAILED DESCRIPTION OF THE INVENTION

Figure 1A:
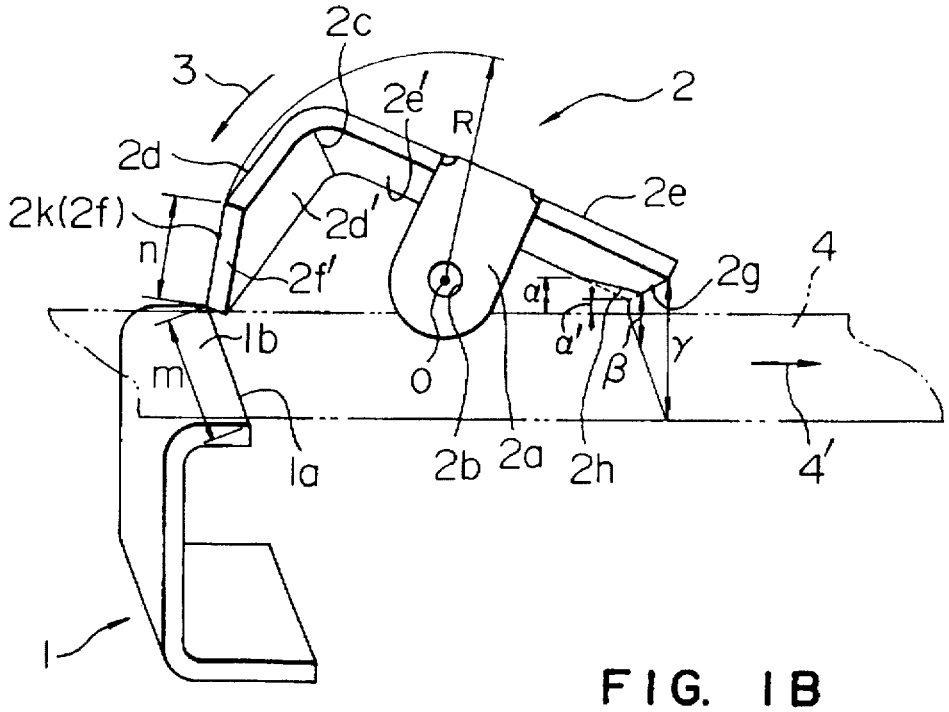
FIG. 1A is a diagram for explaining an essential portion of the embodiments according to the present invention.

FIG. 1A illustrates one embodiment of the invention, and shows a stationary blade 1 and a rotary blade 2 in projection from a direction of extension of a rotary axis Q of the rotary blade 2 toward a cutting finishing side (the front side of the drawing). The drawing illustrates a condition in which, by rotating/driving the rotary blade 2 in a direction indicated by an arrow 3, a sheet to be cut 4 is cut between an end edge 2*k* of the rotary blade 2 (defined as a ridge between end surface 2*f* of the rotary blade and one of the front and rear surfaces of the rotary blade) and an end edge 1*a* of the stationary blade 1 while the two blades are press-contacted.

Figure 2:
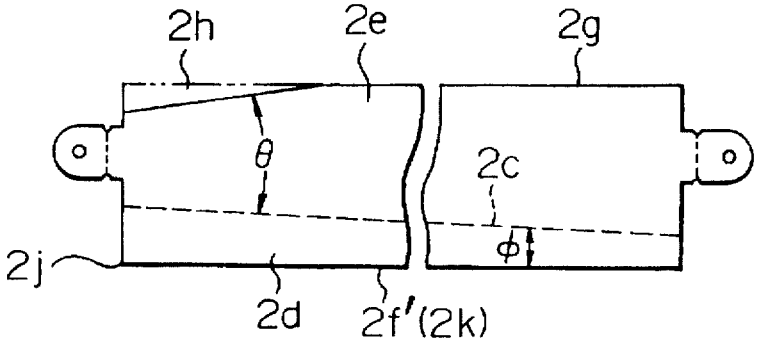
FIG. 2 is a development view of the rotary blade shown in FIG. 1A.

Referring to FIG. 1A, the rotary blade 2 is formed of a plate material having a plate shape, as shown in FIG. 2, which is bent along a dashed line 2C. The rotary axis Q is located in a space surrounded both by surfaces 2*d*' and 2*e*' of portions 2*d* and 2*e* defined by the bend line 2*c*, the surfaces 2*d*' and 2*e*' being located on an inside surface of the plate material after being bent.

According to the rotary blade being formed by bending a flat plate toward the side of the expected rotary axis Q of the blade and along a bend line c, both portions 2*d* and 2*e* defined by bend line 2*c* can be located in the vicinity of the rotary axis Q even if their widths must be increased because of the rigidities. Thus, cross-sectional inertia moments (rigidity) of the rotary blade 2 in the circumferential and radial directions, i.e., both in the main shear-reaction direction and the press-contact direction can be increased, and also, the space occupied by the rotary blade 2 during the rotation can be decreased.

Figure 1B:
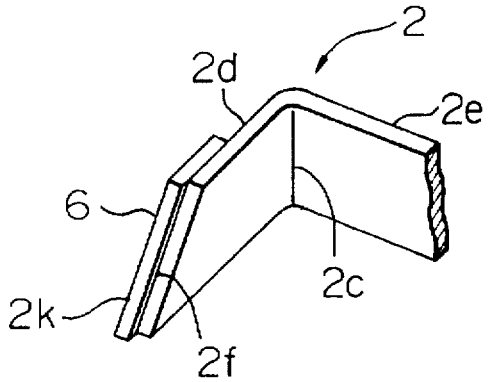
FIG. 1B is a diagram showing, in detail, a blade edge portion of a rotary blade including a tip.

In the rotary-type sheet cutter according to the first aspect of the invention, as shown in FIGS. 1A and 1B, an angle opening toward a cutting starting end (the rear side in the drawing) is defined between the end edge 2*k* of the rotary blade 2 and the bend line 2*c*.

The portion 2*e* which does not include the end edge 2*k* can be located in parallel to or at a small angle from the rotary axis Q in the condition of the above-mentioned shear angle creating method (2) whereas the end edge 2*k* is inclined relative to the rotary axis Q. Consequently, the level of the highest point of the rotary blade (at the cutting finishing side) can be lowered, which is advantageous in reducing the overall size of the cutter.

Figure 3A:
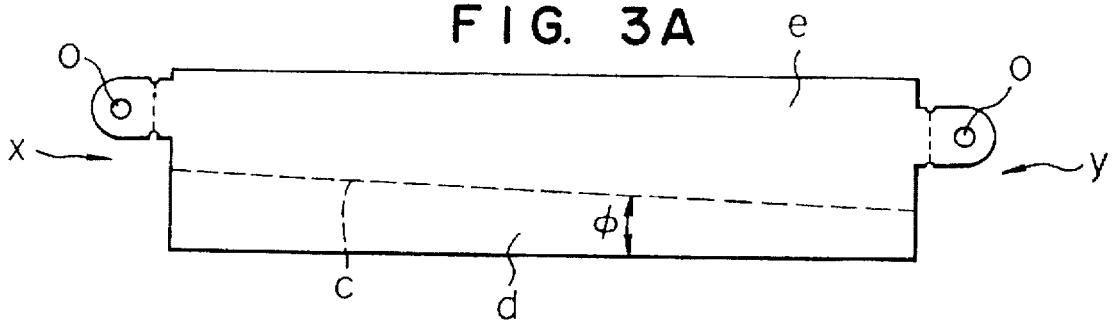
FIG. 3A is a flat plate of the rotary blade $B_1$, before bending at a line c, having an end edge which is not in parallel (at an angle ø) to the line c.
Figure 3B:
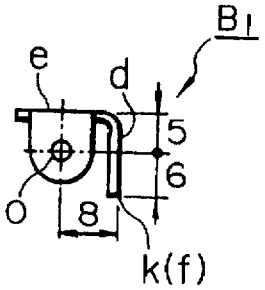
FIG. 3B is a side view of the rotary blade as indicated by arrow x in FIG. 3A, the blade being shown in an already bent state.
Figure 3C:
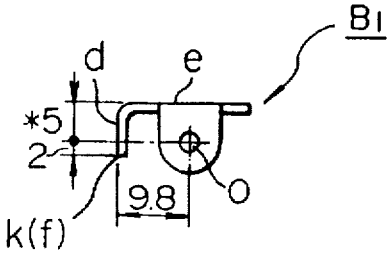
FIG. 3C is a side view of the rotary blade as indicated by arrow y in FIG. 3B, the blade being shown in an already bent state.
Figure 3D:
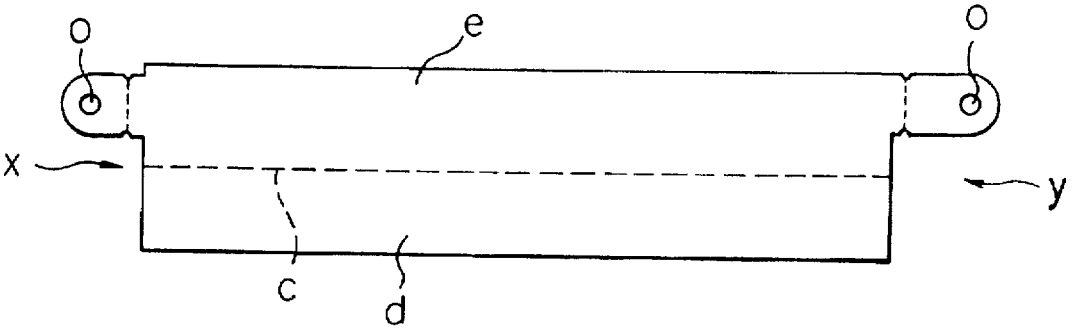
FIG. 3D is a flat plate of the comparative rotary blade $B_2$ before bending along a line c.
Figure 3E:
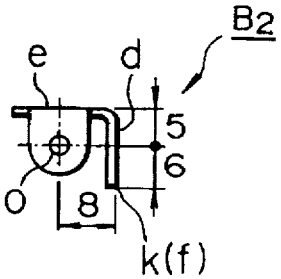
FIG. 3E is a side view of the rotary blade as indicated by arrow x in FIG. 3D, the blade being shown in an already bent state.
Figure 3F:
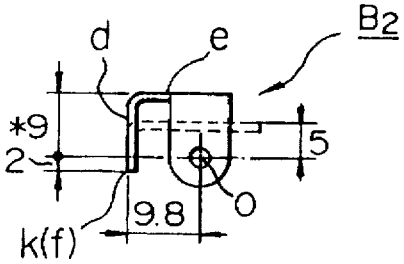
FIG. 3F is a side view of the rotary blade as indicated by arrow y in FIG. 3D, the blade being shown in an already bent state.

FIGS. 3A to 3C and FIGS. 3D to 3F respectively illustrate a rotary blade $B_1$ of the invention and a rotary blade $B_2$ of a comparative example, on which end edges are directly formed. FIGS. 3A and 3D are development views (a main body is rectangular in either case), FIGS. 3B and 3E are cross-sectional views at the cutting starting side, and FIGS. 3C and 3F are cross-sectional views at the cutting finishing side. With respect to a bending line c formed when each member is bent, the end edge k of the rotary blade $B_1$ is set at an angle ø in a direction to open toward the cutting starting side according to the first aspect of the invention, and the end edge k of the rotary blade $B_2$ is set in parallel. In either case, the end edge k and a rotary axis Q are kept at a predetermined angle and at a predetermined positional relationship (the horizontal distance is 8 mm and the vertical distance is 6 mm at the cutting starting side, and the horizontal distance is 9.8 mm and the vertical distance is 2 mm at the cutting finishing side). The rotary blades $B_1$ and $B_2$ have the same cross-sectional configuration at the cutting starting end. It can be understood from the comparison that the height at the cutting finishing end (marked with *) is 5 mm in the case of the rotary blade $B_1$ and 9 mm in the case of the rotary blade $B_2$, and that the height of the rotary blade $B_1$ is 4 mm lower than that of the rotary blade $B_2$, so that the space occupied by the rotary blade during the rotation is decreased, thereby reducing the size of the cutter. In FIG. 3F, a dashed line depicts a configuration when the portion e which does not include the end edge k extends in parallel to the axis Q, which configuration is the same as shown in FIG. 3C.

As shown in FIG. 1, if the portion 2*e* without the end edge 2*k* is inclined at an excessively large angle to the axis Q in the direction shown in FIG. 1A (in the direction to open toward the cutting finishing side), the level of the highest point of the cutting finishing side is disadvantageously raised, as described before, and in a stand-by state of the cutter (in the state in which the two blades are separated to wait for delivery of a sheet material to be cut), the edge g of the rotary blade far from the blade edge interrupts feeding of the sheet material to be cut. Also, if the portion 2*e* is inclined at an excessively large angle in the direction reverse to the direction shown in FIG. 1A, the width of the plate material must be enlarged to withstand the increased shear forces, thereby decreasing the efficiency of use of the plate material (the situations are the same as in the case of FIG. 4). Therefore, the portion 2*e* should be inclined in the direction shown in FIG. 1A within predetermined range so as not to interrupt feeding of the sheet material to be cut.

Figure 4:
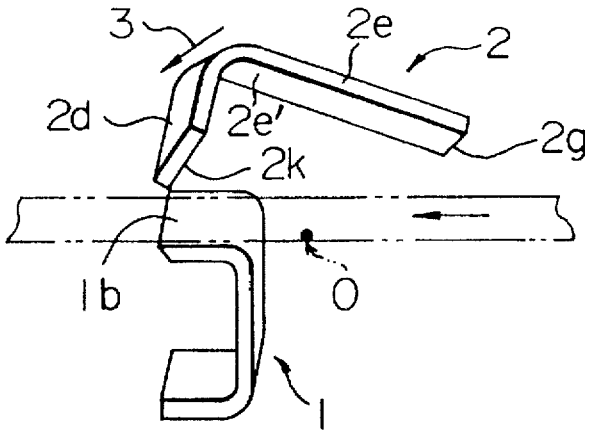
FIG. 4 is a diagram for explaining a sheet cutter of the invention of an internal-contact stationary blade type.

FIG. 4 shows another embodiment of the invention illustrative of a positional relationship between an end edge 2*k* of a rotary blade 2 and a rotary axis Q in a cutter of the type in which the position of the stationary blade 1 is reversed from FIGS. 1–3. Referring to the drawing, the rotary blade 2 must have a large enough depth formed by the bending process so that the inner side surface 2*e*' of one portion 2*e* at the cutting starting side will not collide against an upper surface 1*b* of the stationary blade 1 at the end of the cutting operation. For this purpose, the portion 2*e* is inclined at a small angle in the direction reverse to the direction shown in FIG. 4 or FIG. 1A. The efficiency of the plate material is the same in this embodiment as in the case of FIG. 1 described above. Therefore, the portion 2*e* of the rotary blade and the rotary axis Q should be kept within a predetermined range of relatively small angles.

Next, the function of the invention according to the second aspect will be described.

FIGS. 1 and 4 are diagrams showing one embodiment of the second aspect, and FIGS. 7 and 8 are diagrams for explaining the function of the second aspect.

Figure 7A:
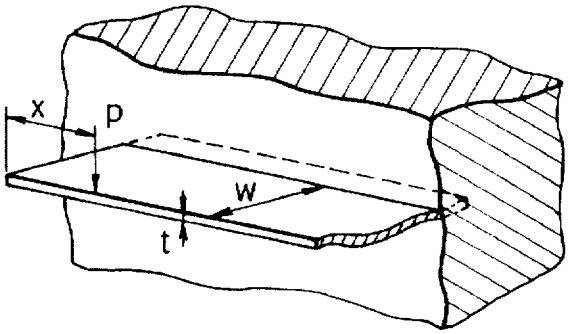
FIGS. 7A and 7B are diagrams for explaining a second aspect of the invention and describing a decrease in the rigidity of an end portion of a cutting edge in the direction of plate thickness.
Figure 7B:
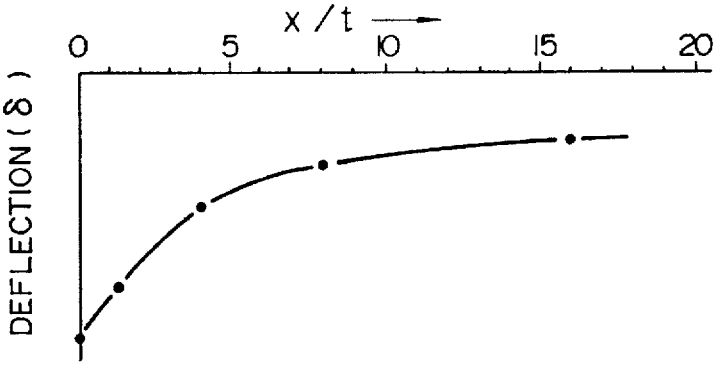

FIG. 7A shows a model of a cantilever having a plate thickness t=1 mm, an extension width w=8 mm, Young's modulus E=20,000 kgf/mm$^2$, and Poisson's ratio v=0.3, with a cantilever having a finite breadth (x =0), and FIG. 7B illustrates the load position when a unit movement load P is applied to the distal end of the lever and a deflection δ at the position which are obtained by the finite element method. Referring to FIG. 7A, the point of x=0 is of the cutting starting end which extends as a corner end. The results show that the bending degree at the cutting starting end is about 4 times larger than that of the steady portion (the rigidity is about ¼ as high).

Referring to FIG. 7A, the point of x=0 is supported by the portion where x is positive but not by the portion where x is negative because there is no lever in that direction. Simply, the force action point of x=0, which is not supported by the portion where x is negative, is presumed to have about ½ of the rigidity of the steady portion. When a load is applied to the steady portion and the steady portion is bent, a widthwise tensile force is generated in the lever, and this tensile force also contributes to the rigidity. However, since the point x=0 is an end portion and has no such tensile force, contribution of the tensile force to the rigidity does not occur. Therefore, as described above, the rigidity is as low as about ¼ of that of the steady portion. This effect is produced not only in the case where a cutting edge is directly formed on a bent member but also in the case where a cutting edge is formed on a tip member. Moreover, the effect is produced in the stationary blade in some form. Thus, the smooth start of contact between the two blades is ensured.

The above-described condition is satisfied by each of the rotary blades shown in FIGS. 1 to 5.

Figure 8A:
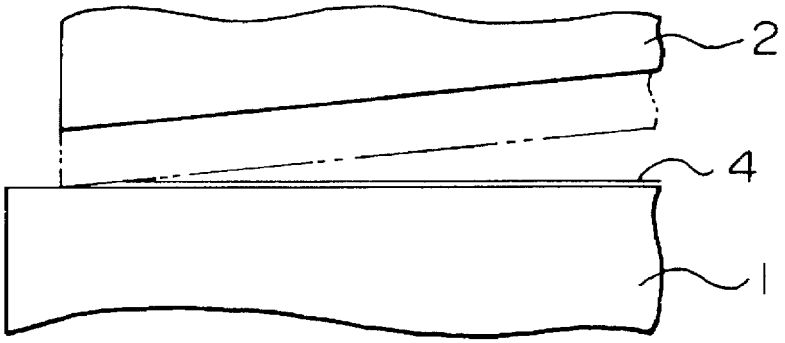
FIGS. 8A to 8C are diagrams for explaining the second aspect of the invention.
Figure 8B:
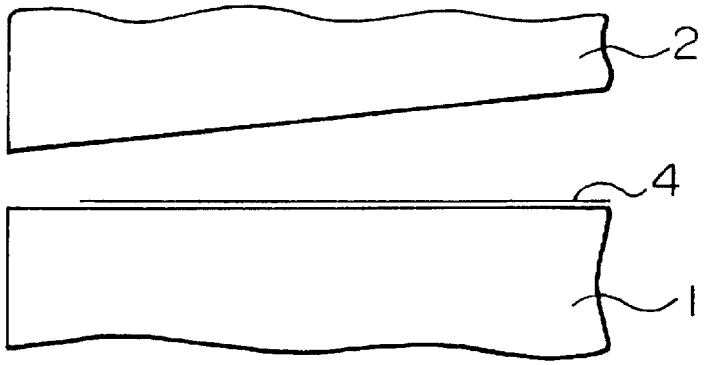
Figure 8C:
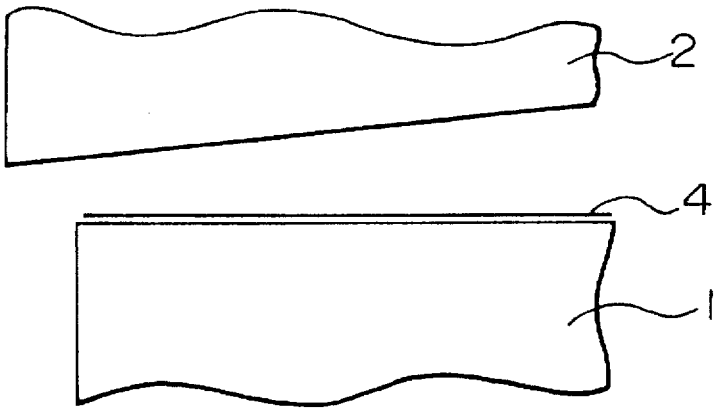

FIGS. 8A to 8C are diagrams illustrative of relative positional relationships of a stationary blade 1, a rotary blade 2 and a sheet to be cut 4 at the cutting starting side, the two blades being in the standby state.

Referring to FIG. 8A, the rotary blade 2 starts to rotate, is lowered as indicated by a phantom line, starts to contact with the stationary blade 1, and cuts the sheet to be cut 4. In order to produce the effect of the second aspect of the invention, the rotary blade must have a corner end at the cutting starting side, and also, the corner end must start to contact with the stationary blade first. Two forms of the contact start are shown in FIGS. 8A and 8B. The corner end first starts to contact with a steady portion of the stationary blade in the form of FIG. 8A, and with a corner end of the stationary blade in the form of FIG. 8B, thereby producing the effect of the second aspect. In FIG. 8C, however, not the corner end but a steady portion of the rotary blade starts the contact first, so that the effect of the second aspect will not be produced.

As noted above, FIGS. 1A and lB are diagrams showing embodiments of a rotary-type sheet cutter according to first, second and third aspects of the present invention in projection from a direction of extension of a rotary axis of a rotary blade. FIG. 1A shows a condition in which, after a sheet 4 to be cut has been fed in a direction indicated by an arrow 4' in the stand-by state of the sheet cutter, the rotary blade 2 starts to rotate in a direction indicated by an arrow 3, and its end edge 2*k* and an end edge 1*a* of a stationary blade 1 start to contact with each other at the cutting starting ends of the end edges.

The stationary blade 1 is obtained by bending a rectangular plate material into a substantially U-shaped cross-sectional configuration so that a bend line will extend in parallel to long sides of the plate material. The stationary blade 1 extends, in a bridge-like manner, between a pair of side plates (not shown) which are spaced in a direction perpendicular to the sheet surface, and both ends of the stationary blade 1 are securely fixed on the side plates. Further, a straight end edge 1*a* is formed at an outside distal-end edge portion of a parallel side of the U-shaped cross-sectional configuration, and thus, an upper surface 1*b* of a portion extending toward the end edge 1*a* serves as a guide surface for the sheet 4 to be cut.

Figure 5A:
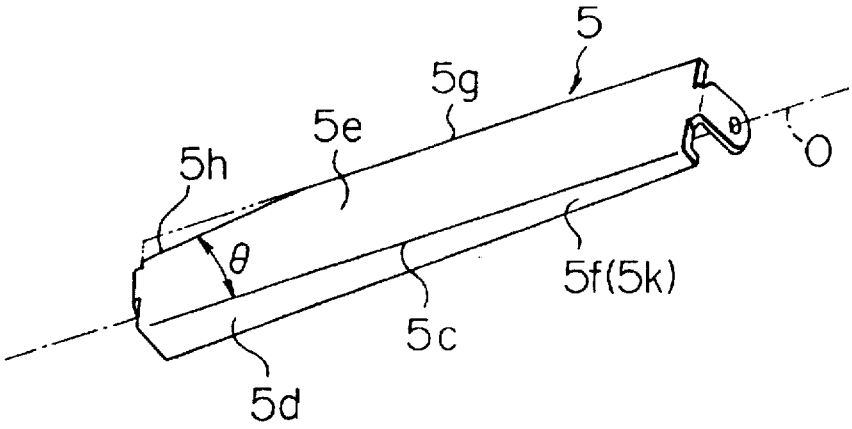
FIG. 5A is a diagram showing another embodiment of a rotary blade according to the invention.
Figure 5B:
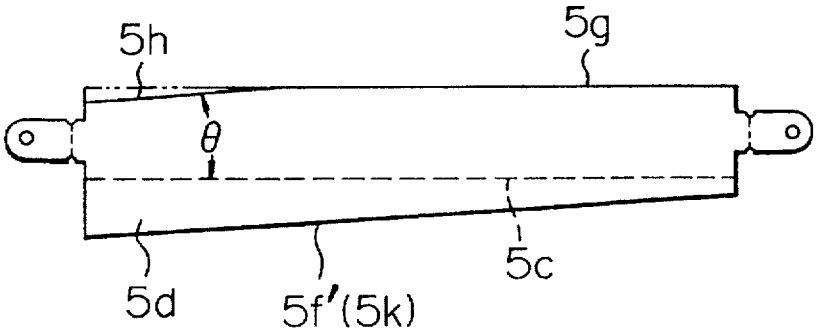
FIG. 5B is a development view of the same.

The rotary blade 2 is obtained by punching a plate material into a predetermined shape shown in a development view of FIG. 2, and bending it along a dashed line to have an L-shaped cross-sectional configuration and edging/grinding one or both of the two surfaces of the punched plate material to define a cutting edge. FIG. 2 is the development view of the plate material in which both end edges 2*f* and 2*g* of the plate material are in parallel to each other so that the efficiency of use of the plate material is high. FIG. 5A is a perspective view of a plate material after the bending process, and FIG. 5B is a development view of the same. In the embodiment, the highest position of one edge 5*g* on a cutting finishing side is lower. As shown in FIGS. 2 and 5, the plate material extends in the widthwise direction so that end surface 2*f* will be an extending front surface, and consequently, a corner end 2*j* is formed at the cutting starting end. The end edge is defined by a ridge between the above-mentioned end surface 2*f* and a surface which will be located outside when the plate material is bent. As shown in FIG. 1A, a pin (not shown) is planted, by insertion or caulking, in pin holes 2*b* bored in bearing bracket portions 2*a* on both ends of the rotary blade 2, and the pin is rotatably supported in a bearing hole (which center will be the rotary axis Q) formed in a bracket (not shown) which extends from the side plate or the stationary blade 1.

Figure 9:
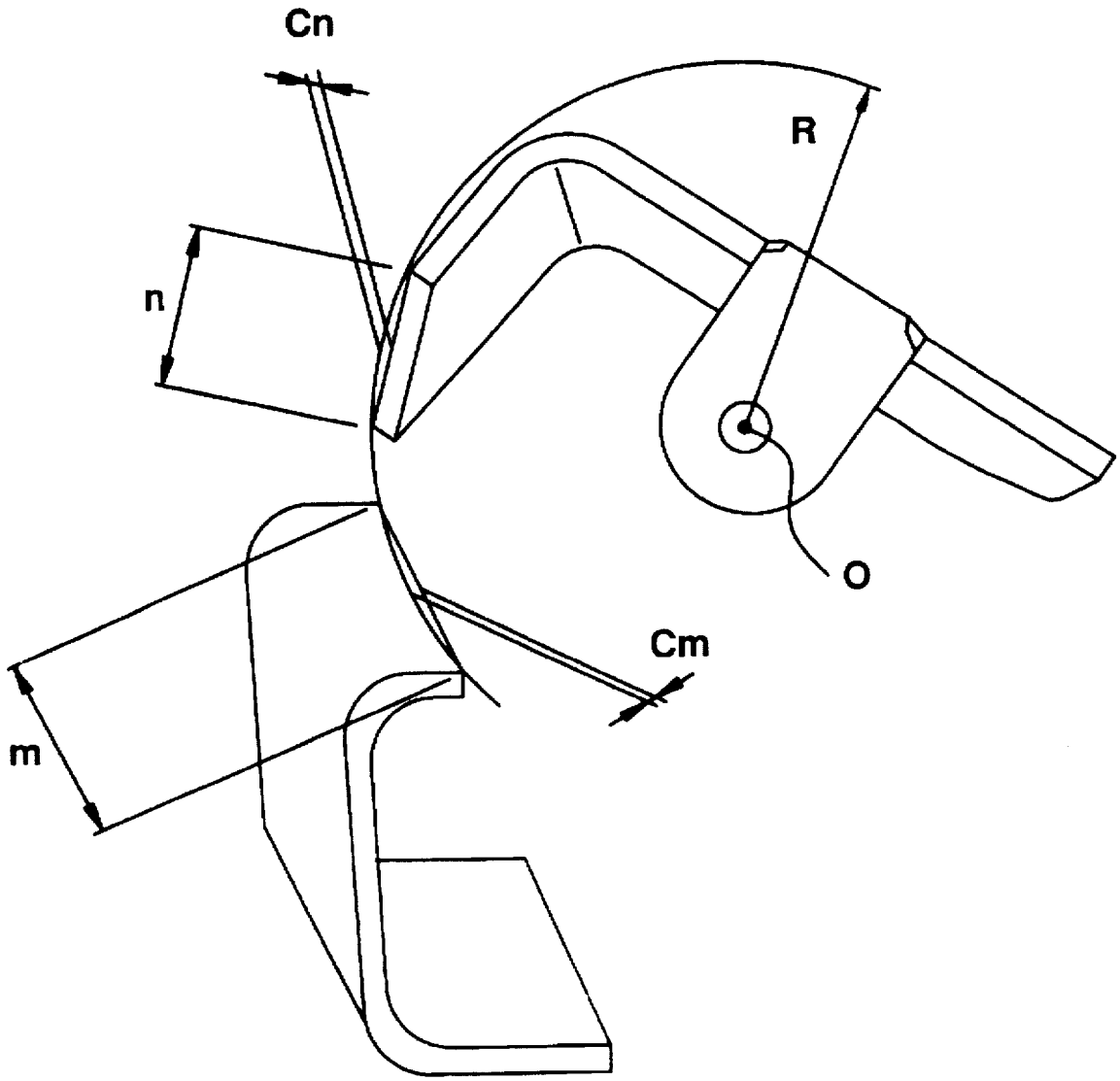
Figure 10A:
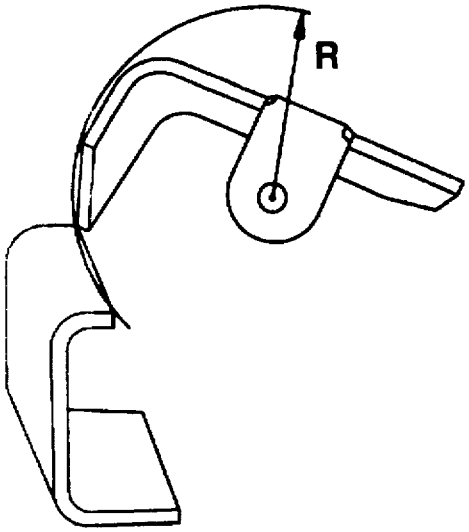
Figure 10B:
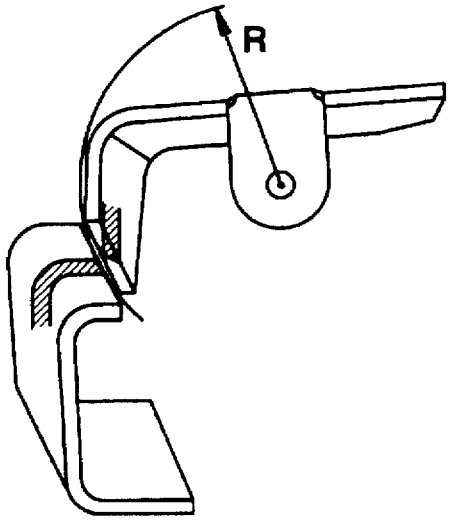
Figure 10C:
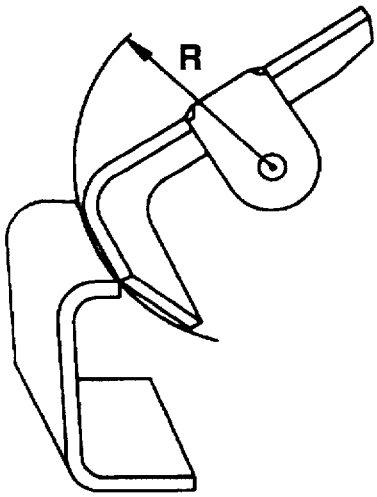

FIG. 9 corresponds to FIG. 1, in which the rotary blade is at its waiting position in which it is not engaged with the stationary blade. The rotary blade rotates as follows:

(a) When the rotary blade rotates around the axis, its end edge also rotates around the axis and, at first, the end edge at the cutting starting side is brought into contact with the end edge of the stationary blade as shown in FIG. 10(*a*).

(b) When the rotary blade rotates further, both blades are in cross engagement (i.e., intersection contacting) with each other at their end edges as shown in FIG. 10(*b*). The hatching on the blades in the drawing figures shows the engagement position.

(c) FIG. 10(*c*) shows the state of the finished shearing operation. The end edge of the rotary blade at the cutting ending side is in contact with the end edge of the stationary blade at its cutting ending side. The cutting starting and cutting ending points on the end edges of the rotary and stationary blades are not necessarily located at the corners of the blades.

The end edge (2*k*) of the rotary blade is oblique with its length "n" (See FIG. 1), and therefore at least a portion of the end edge recedes inside from the locus, which has a radius of "R" (see FIG. 9), by a maximum distance of Cn. On the other hand, the end edge (1*a*) of the stationary blade is oblique with its length "m", and therefore it protrudes inside from the locus of the rotary blade by a maximum distance of Cm. In the case where the cutting starting and finishing end points on both blades are arranged on the locus of the end edge of the rotary blade, the distance Cm is greater than Cn because "m">"n". Flexure of the end edge regions of both blades due to engagement pressure is maximum at their central portion. Therefore, a generally constant contacting pressure can be obtained through the entirety of the lengths of both blades, which relates to the change of the interference amount between the blades.

Figure 11:
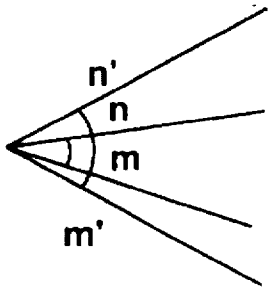

According to the present invention, the shearing angle can be proportionally as large as the value "m"+"n" (see FIG. 11), while the shearing force can be restrained in inverse proportion to the shearing angle. On the other hand, the flexures of both blades can be proportionally as small as the value "m"−"n". Therefore, both the shearing force and the contacting pressure can be restrained to a small level.

Figure 12A:
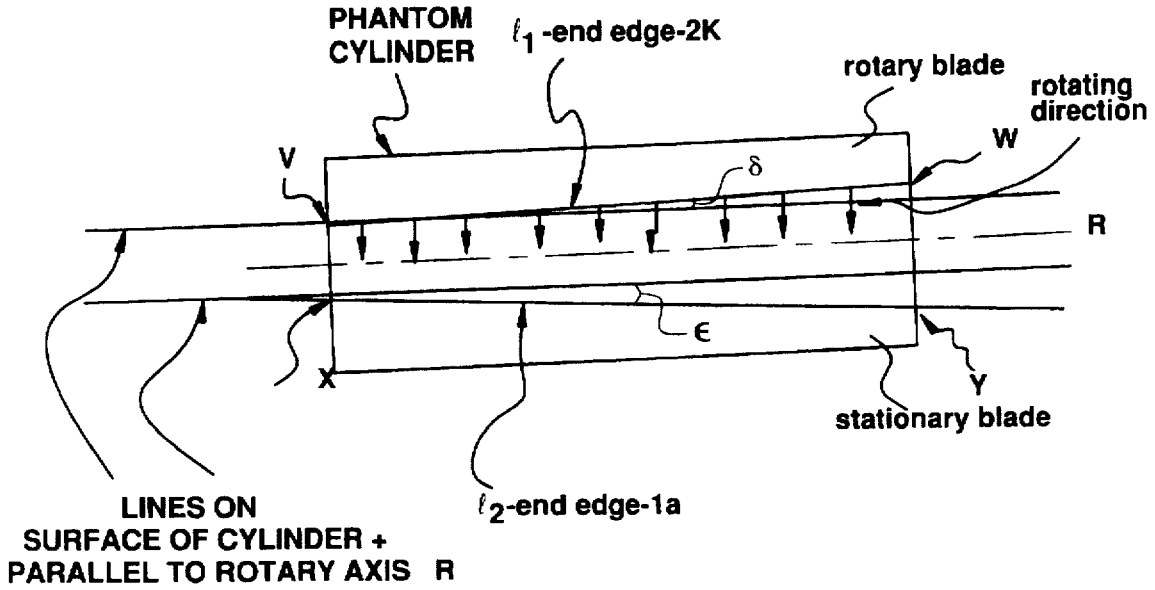
Figure 12B:
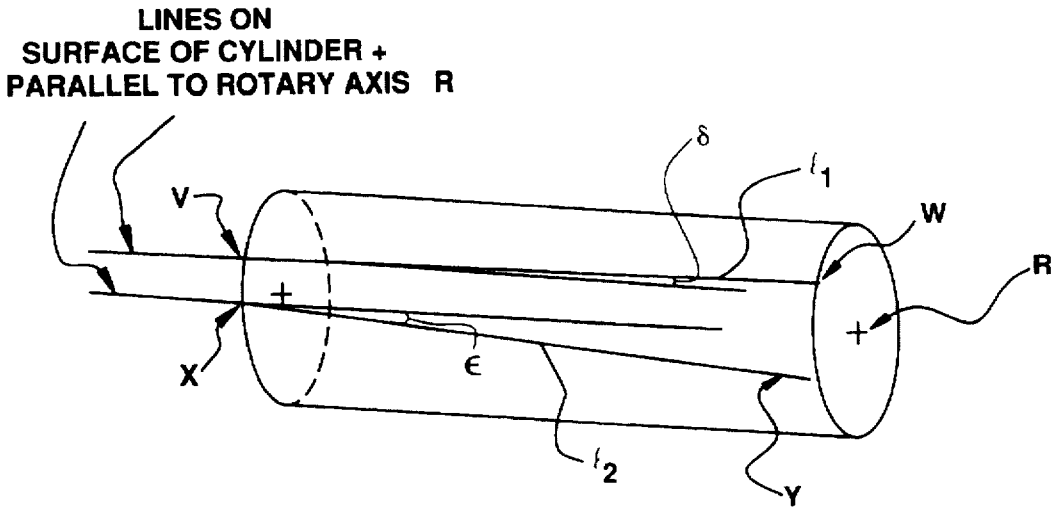
Figure 13A:
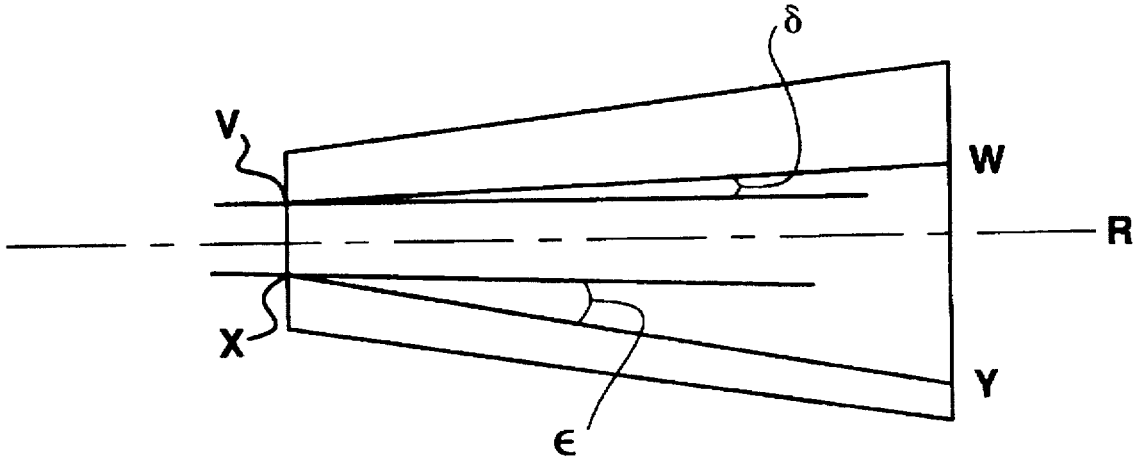
FIGS. 13(*a*) and 13(*b*) are views of an alternate construction similar to the one shown in FIGS. 12(*a*) and 12(*b*).
Figure 13B:
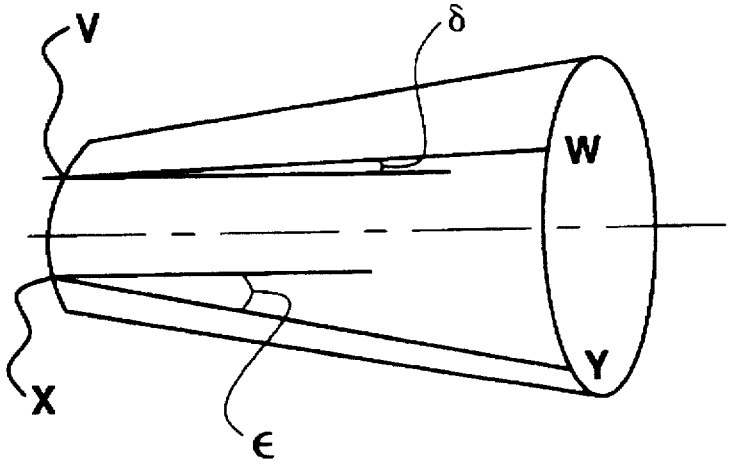

FIGS. 12 and 13 show the phantom cylinder traced by the rotary blade as it moves about the rotary axis R. The cutting starting and cutting finishing end points of the rotary blade, V and W, respectively, define two phantom end circles of a phantom cylinder as the rotary blade is rotated around the rotary axis. The cutting starting and cutting finishing end points of the stationary blade, X and Y, respectively, are on respective ones of the phantom end circles. A first angle ($\delta$) is defined between the end edge 2*k* of the rotary blade and a line on the surface of the phantom cylinder drawn parallel to the rotary axis R. Likewise, a second angle ($\epsilon$) is defined between the end edge 1*a* of the stationary blade and another line on the surface of the phantom cylinder drawn parallel to the rotary axis R. The first angle is less than the second angle, i.e. $1_1$ (which corresponds to the appearance length "n" in FIG. 1A) is less than $1_2$ (which corresponds to the appearance length "m" in FIG. 1A). Intermediate portions of the rotary and stationary blades, respectively, between the cutting starting and cutting finishing end points are disposed inside the circumferential surface of the phantom cylinder (see FIGS. 9 and 10(*b*), for example).

FIGS. 13(*a*) and 13(*b*) are substantially the same as FIGS. 12(*a*) and 12(*b*), respectively, except that the phantom end circles in FIGS. 13(*a*) and 13(*b*) have different radii at opposite ends of the phantom cylinder. Also, the rotary blade 2 is swung within a range of one rotation or a predetermined angle by drive means (not shown).

The above-mentioned rotary axis Q of the rotary blade 2 is located in a space surrounded both by the surfaces 2*d*' and 2*e*' which will be located inside when the plate material is bent, or both of their extension planes. Thus, both of the portions 2*d* and 2*e* of the rotary blade 2 which are defined by a bend line 2*c* have large widths. Therefore, in spite of the fact that the rotary blade 2 has large cross-sectional inertia moments in directions of both the surfaces 2*d* and 2*e*, they are enclosed within a range of a radius R from the rotary axis Q, so that rotation of the rotary blade 2 about the rotary axis occupies a small space.

The bend line 2*c* and the end edge 2*k* define an angle in a direction to open toward the cutting starting side. More specifically, as shown in the development view of FIG. 2, the bend line 2*c* and the end surface 2*f* including the end edge define an angle ø in a direction to open toward the cutting starting end (the left end portion in the drawing). An angle defined between one of the portions 2*e* and the rotary axis Q is smaller than the angle ø, and a sum of the two angles is an angle of the end edge 2*k* with respect to the rotary axis Q, thereby forming a component of a shear angle. That is to say, the cutter of FIG. 1 is of the first aspect of the invention in respect of the angular relationship between the bend line and the end edge.

In the cutter of FIG. 1, both the end edges are straight and easy to be machined, and the end edge 1*a* of the stationary blade 1 is inclined at an angle relative to the rotary axis Q of the rotary blade 2 (this angle corresponds to a chord m with respect to the rotary axis Q), and further, the end edge 2*k* of the rotary blade 2 is inclined at an angle relative to the axis Q (this angle corresponds to a chord n with respect to the rotary axis Q). The end edges extend in directions to increase the shear angle.

In this case, the two blades are assembled in, such a manner that the end edges 1*a* and 2*k* will start and end contacting with each other at the cutting starting end and the cutting finishing end without substantially interfering with each other, so that the chord m is made larger than the chord n by an appropriate amount. Consequently, the two blades interfere with each other in a press-contact direction at an intermediate portion except for the opposite ends, thus compensating for a decrease in the press-contact force due to bending of the two blades in the press-contact direction. In other words, under the condition m>n, for example, the distance between the center of the end edge 1*a* of the stationary blade 1 and the rotary axis Q is shorter than the distance between the center of the end edge 2*k* of the rotary blade 2 and the rotary axis Q, and therefore, the two end edges interfere at a maximum in the center region, thus compensating for a decrease in the press-contact force due to bending of the end edges.

The rotary blade 2 of FIG. 1 is representative of a second aspect of the invention because the end surface 2*f*' which extends to form the corner end at the cutting starting side faces the circumferential direction as a result of rotational movement, and because the corner end starts to contact with the stationary blade first.

Figure 6:
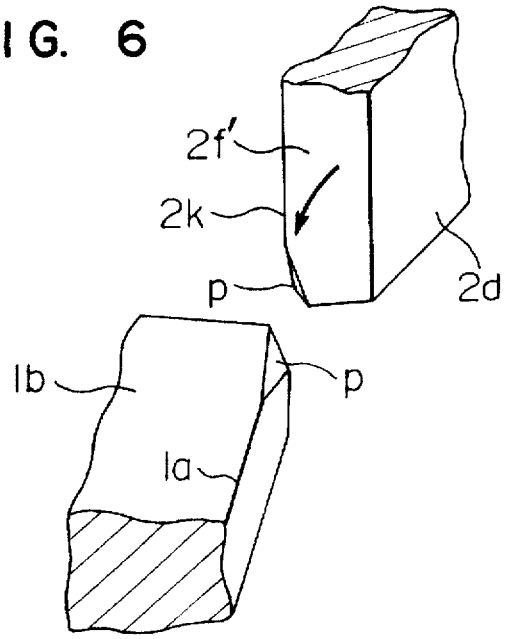
FIG. 6 is a diagram showing a shape of chamfered portions of cutting starting ends of two blades.

Moreover, in the cutter shown in FIG. 1A, both the two blades are chamfered at the cutting starting ends of the end edges in the embodiment, as shown in FIG. 6, to form chamfered surfaces P which enable a quieter start of the contact between the blades.

Furthermore, as shown in FIGS. 1, 2, 4 and 5, the portion 2*e*, 5*e* of the rotary blade 2, 5 which does not include the end edge 2*k*, 5*k* is formed in such a manner that a portion (2*h*, 5*h*) of the end edge 2*g*, 5*g* opposite to the bend line 2*c*, 5*c* from the cutting starting end and extending to some extent toward the cutting finishing end defines an angle θ in a direction to open toward the cutting finishing side with respect to the bend line 2*c*, 5*c*.

FIG. 2 is the development view of the rotary blade 2 shown in FIG. 1. The end surface 2*f* including the end edge 2*k* and the other end surface 2*g* are in parallel to each other, to enable efficient use of the plate material. In this case, however, while the cutter is used, the cutting starting end of the end surface in the stand-by state often interrupts free feeding of the sheet material to be cut, and consequently, the end surface is cut off, as indicated by the line 2*h*. In FIG. 1A (not in the stand-by state), the end surface and the sheet to be cut are separated by a gap α' if this cutting off operation is not performed, but will have a larger gap α as a result of the cutting off operation.

FIG. 1B shows an example in which an end edge is defined, as an end edge 2*k*, by a tip plate 6 whose rear surface is bonded on one of the front and rear surfaces of the bent member in the vicinity of one of the end surfaces 2*f*. The end edge 2*k* is of a ridge between one of the widthwise end surfaces of the tip plate 6 which is far from the bend line 2*c*, and the front side surface.

Figure 5C:
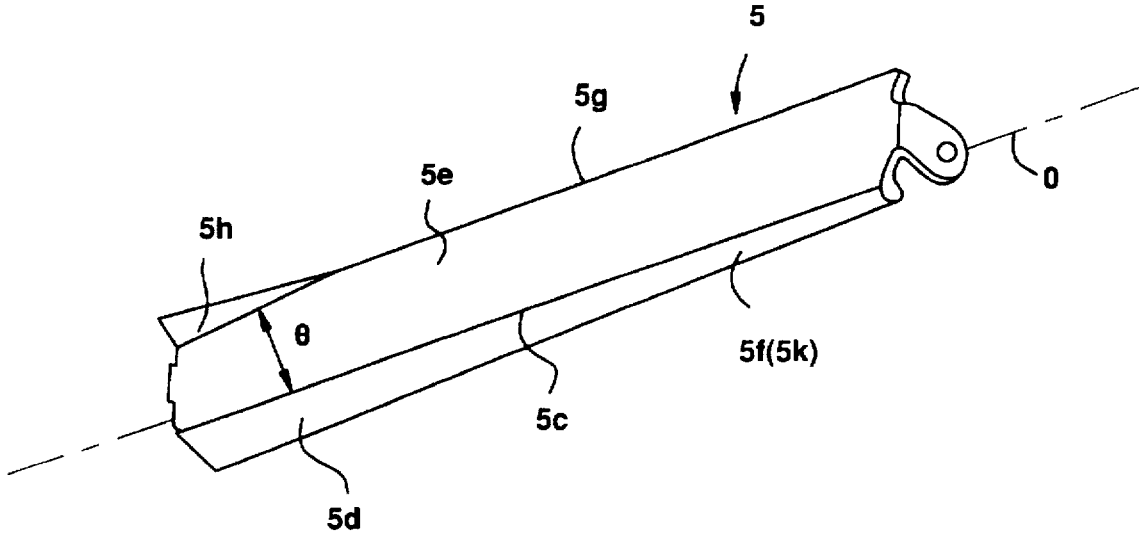
FIG. 5C is a diagram similar to FIG. 5A, except that a rear portion of the rotary blade is bent instead of being removed.

Since the above-described cut-off portion (2*h*) is generally the closest portion to the cutting starting end, an increase in bending of the rotary blade caused by a shear reaction due to this cutting off operation is small. If the bending is problematic, the portion corresponding to the cut off portion is bent in a direction away from the rotary axis Q, as shown in FIG. 5C, so as to prevent interruption of the sheet feeding.

Referring to FIG. 5B, the edge surface 5*g* is substantially in parallel to the bend line 5*c*, and therefore, defines an angle in a direction to open toward the cutting starting side with respect to the end surface 5*f* including the end edge. However, a portion at the cutting starting end is cut off, i.e., removed, along a line 5*h* parallel to the end surface 5*f* for efficient use of the plate material, thus defining an angle θ in a direction to open toward the cutting finishing side with respect to the bend line 5*c*.

According to the first aspect of the present invention, as described above, since the end edge defines an angle in a direction to open toward the cutting starting side with respect to the bend line, the rotary blade itself has an element of a shear angle. Thus, the required shear angle can be obtained without inclining the rotary axis by a large degree with respect to the stationary blade (set horizontally), and also, the level of the rotary blade at the cutting finishing side can be lowered, thereby facilitating size reduction of the cutter. Further, the rotary axis Q of the rotary blade is located inside in the bending direction so that, while inertia moments relative to two axes extending perpendicular to each other in a cross section of the rotary blade, i.e., the rigidity, is kept high, the cross-sectional configuration can be enclosed within the range of the minimum radius from the rotary axis.

Next, according to the second aspect of the present invention, the rotary blade extends at the cutting starting side to form the corner end, and one of the ridges of the front surface (the end surface) of the rotary blade is employed as the end edge, whose end surface rotates in the circumferential direction. Therefore, the peculiarity of the cutting starting end portion of the end edge, i.e., a low rigidity in a direction of the plate thickness, is utilized for a smooth start of the contact between the end edges, thus achieving increases in allowable values of assembly errors, a quiet start of the contact, and removal or simplification of a guide plate for the end edge.

What is claimed is:

1. A rotary-type sheet cutter for cutting a continuous sheet material comprising:

a stationary blade having an end edge extending along a widthwise direction of the sheet material; and a rotary blade having an end edge which rotates about a rotary axis (O) extending along the widthwise direction of the sheet material during rotation of the rotary blade, the end edge of the rotary blade intersection-contacting the end edge of the stationary blade under pressure so as to cut the sheet material along the widthwise direction when the rotary blade rotates, wherein:

the rotary blade comprises a flat plate bent along a first bend line (c) which extends along the widthwise direction of the sheet material, the end edge of the rotary blade and the first bend line (c) forming an angle ($\phi$) opening toward a cutting starting side, and wherein:

cutting starting and cutting finishing end points on the end edge of the rotary blade define two phantom end circles of a phantom cylinder as the rotary blade is rotated around the rotary axis, cutting starting and cutting finishing end points on the end edge of the stationary blade are on respective ones of the phantom end circles, a first angle is defined between the end edge of the rotary blade and a first imaginary line on the surface of the phantom cylinder, said first line being drawn parallel to the rotary axis, and a second angle is defined between the end edge of the stationary blade and a second imaginary line on the surface of the phantom cylinder, said second line being drawn parallel to the rotary axis, said first angle being less than said second angle, and intermediate portions of the rotary and stationary blades, respectively, between the cutting starting and cutting finishing end points are disposed inside the circumferential surface of the phantom cylinder.

2. A rotary-type sheet cutter according to claim 1, wherein the flat plate is bent toward the rotary axis (O) of the rotary blade along the first bend line (c).

3. A rotary-type sheet cutter according to claim 1, wherein at least a portion of a rear end edge of the rotary blade comprises a cut-off portion, and wherein the cut-off portion and the first bend line (c) form an angle ($\Theta$) opening toward a cutting finishing side from the cutting starting side so that the rear end edge of the rotary blade does not interfere with the sheet material as the sheet material passes between said stationary and rotary blades.

4. A rotary-type sheet cutter according to claim 1, wherein at least a portion of a rear end edge of the rotary blade is bent along a second bend line (h) in a direction away from the rotary axis, and wherein the second bend line (h) and the first bend line (c) form an angle ($\Theta$) opening toward a cutting finishing side from the cutting starting side so that the rear end edge of the rotary blade does not interfere with the sheet material as the sheet material passes between said stationary and rotary blades.

5. A rotary-type sheet cutter for cutting a continuous sheet material comprising:

a stationary blade having an end edge extending along a widthwise direction of the sheet material; and a rotary blade having an end edge portion which rotates about a rotary axis (O) extending along the widthwise direction of the sheet material during rotation of the rotary blade, the end edge portion of the rotary blade being provided with a tip plate having an end edge (k) intersection-contacting the end edge of the stationary blade under pressure so as to cut the sheet material along the widthwise direction when the rotary blade rotates, wherein:

the rotary blade comprises a flat plate bent along a first bend line (c), and the end edge (k) of the tip plate and the first bend line (c) form an angle ($\phi$) opening toward a cutting starting side, and wherein:

cutting starting and cutting finishing end points on the end edge of the rotary blade define two phantom end circles of a phantom cylinder as the rotary blade is rotated around the rotary axis, cutting starting and cutting finishing end points on the end edge of the stationary blade are on respective ones of the phantom end circles, a first angle is defined between the end edge of the rotary blade and a first imaginary line on the surface of the phantom cylinder, said first line being drawn parallel to the rotary axis, and a second angle is defined between the end edge of the stationary blade and a second imaginary line on the surface of the phantom cylinder, said second line being drawn parallel to the rotary axis, said first angle being less than said second angle, and intermediate portions of the rotary and stationary blades, respectively, between the cutting starting and cutting finishing end points are disposed inside the circumferential surface of the phantom cylinder.

6. A rotary-type sheet cutter according to claim 5, wherein the flat plate is bent toward the rotary axis (O) of the rotary blade along the first bend line (c).

7. A rotary-type sheet cutter according to claim 5, wherein at least a portion of a rear end edge of the rotary blade comprises a cut-off portion, and wherein the cut-off portion and the first bend line (c) form an angle ($\Theta$) opening toward a cutting finishing side from the cutting starting side so that the rear end edge of the rotary blade does not interfere with the sheet material as the sheet material passes between said stationary and rotary blades.

8. A rotary-type sheet cutter according to claim 5, wherein at least a portion of a rear end edge of the rotary blade is bent along a second bend line (h) in a direction away from the rotary axis, and wherein the second bend line (h) and the first bend line (c) form an angle ($\Theta$) opening toward a cutting finishing side from the cutting starting side so that the rear end edge of the rotary blade does not interfere with the sheet material as the sheet material passes between said stationary and rotary blades.

9. A rotary-type sheet cutter for cutting a continuous sheet material comprising:

a stationary blade having an end edge extending along a widthwise direction of the sheet material; and a rotary blade having an end edge which rotates about a rotary axis (O) extending along the widthwise direction of the sheet material during rotation of the rotary blade, the end edge of the rotary blade intersection-contacting the end edge of the stationary blade under pressure so as to cut the sheet material along the widthwise direction when the rotary blade rotates, wherein:

the rotary blade comprises a flat plate bent along a first bend line (c) which extends along the widthwise direction of the sheet material, and wherein a corner portion of the rotary blade at a cutting starting side is the least rigid portion of the rotary blade and is disposed so as to be the first portion of the rotary blade to contact the stationary blade when the rotary blade rotates, and wherein:

cutting starting and cutting finishing end points on the end edge of the rotary blade define two phantom end circles of a phantom cylinder as the rotary blade is rotated around the rotary axis, cutting starting and cutting finishing end points on the end edge of the stationary blade are on respective ones of the phantom end circles, a first angle is defined between the end edge of the rotary blade and a first imaginary line on the surface of the phantom cylinder, said first line being drawn parallel to the rotary axis, and a second angle is defined between the end edge of the stationary blade and a second imaginary line on the surface of the phantom cylinder, said second line being drawn parallel to the rotary axis, said first angle being less than said second angle, and intermediate portions of the rotary and stationary blades, respectively, between the cutting starting and cutting finishing end points are disposed inside the circumferential surface of the phantom cylinder.

10. A rotary-type sheet cutter according to claim 9, wherein the flat plate is bent toward the rotary axis (O) of the rotary blade along the first bend line (c).

11. A rotary-type sheet cutter according to claim 9, wherein at least a portion of a rear end edge of the rotary blade comprises a cut-off portion, and wherein the cut-off portion and the first bend line (c) form an angle (Θ) opening toward a cutting finishing side from the cutting starting side so that the rear end edge of the rotary blade does not interfere with the sheet material as the sheet material passes between said stationary and rotary blades.

12. A rotary-type sheet cutter according to claim 9, wherein at least a portion of a rear end edge of the rotary blade is bent along a second bend line (h) in a direction away from the rotary axis, and wherein the second bend line (h) and the first bend line (c) form an angle (Θ) opening toward a cutting finishing side from the cutting starting side so that the rear end edge of the rotary blade does not interfere with the sheet material as the sheet material passes between said stationary and rotary blades.

13. A rotary-type sheet cutter for cutting a continuous sheet material comprising:

a stationary blade having an end edge extending along a widthwise direction of the sheet material; and a rotary blade having an end edge portion which rotates about a rotary axis (O) extending along the widthwise direction of the sheet material during rotation of the rotary blade, the end edge portion of the rotary blade being provided with a tip plate having an end edge (k) intersection-contacting the end edge of the stationary blade under pressure so as to cut the sheet material along the widthwise direction when the rotary blade rotates, wherein:

the rotary blade comprises a flat plate bent along a first bend line (c), and a corner portion of the rotary blade at a cutting starting side is the least rigid portion of the rotary blade and is disposed so as to be the first portion of the rotary blade to contact the stationary blade when the rotary blade rotates, and wherein:

cutting starting and cutting finishing end points on the end edge of the rotary blade define two phantom end circles of a phantom cylinder as the rotary blade is rotated around the rotary axis, cutting starting and cutting finishing end points on the end edge of the stationary blade are on respective ones of the phantom end circles, a first angle is defined between the end edge of the rotary blade and a first imaginary line on the surface of the phantom cylinder, said first line being drawn parallel to the rotary axis, and a second angle is defined between the end edge of the stationary blade and a second imaginary line on the surface of the phantom cylinder, said second line being drawn parallel to the rotary axis, said first angle being less than said second angle, and intermediate portions of the rotary and stationary blades, respectively, between the cutting starting and cutting finishing end points are disposed inside the circumferential surface of the phantom cylinder.

14. A rotary-type sheet cutter according to claim 13, wherein the flat plate is bent toward the rotary axis (O) of the rotary blade along the first bend line (c).

15. A rotary-type sheet cutter according to claim 13, wherein at least a portion of a rear end edge of the rotary blade comprises a cut-off portion, and wherein the cut-off portion and the first bend line (c) form an angle (Θ) opening toward a cutting finishing side from the cutting starting side so that the rear end edge of the rotary blade does not interfere with the sheet material as the sheet material passes between said stationary and rotary blades.

16. A rotary-type sheet cutter according to claim 13, wherein at least a portion of a rear end edge of the rotary blade is bent along a second bend line (h) in a direction away from the rotary axis, and wherein the second bend line (h) and the first bend line (c) form an angle (Θ) opening toward a cutting finishing side from the cutting starting side so that the rear end edge of the rotary blade does not interfere with the sheet material as the sheet material passes between said stationary and rotary blades.

17. A rotary-type sheet cutter for cutting a continuous sheet material comprising:

a stationary blade having an end edge extending along a widthwise direction of the sheet material; and a rotary blade having an end edge which rotates about a rotary axis (O) extending along the widthwise direction of the sheet material during rotation of the rotary blade, the end edge of the rotary blade intersection-contacting the end edge of the stationary blade under pressure so as to cut the sheet material along the widthwise direction when the rotary blade rotates, wherein:

the rotary blade comprises a flat plate bent along a first bend line (c) which extends along the widthwise direction of the sheet material, the end edge of the rotary blade and the first bend line (c) forming an angle (ϕ) opening toward a cutting starting side, and wherein a corner portion of the rotary blade at a cutting starting side is disposed so as to be the first portion of the rotary blade to contact the stationary blade when the rotary blade rotates, and wherein:

cutting starting and cutting finishing end points on the end edge of the rotary blade define two phantom end circles of a phantom cylinder as the rotary blade is rotated around the rotary axis, cutting starting and cutting finishing end points on the end edge of the stationary blade are on respective ones of the phantom end circles, a first angle is defined between the end edge of the rotary blade and a first imaginary line on the surface of the phantom cylinder, said first line being drawn parallel to the rotary axis, and a second angle is defined between the end edge of the stationary blade and a second imaginary line on the surface of the phantom cylinder, said second line being drawn parallel to the rotary axis, said first angle being less than said second angle, and intermediate portions of the rotary and stationary blades, respectively, between the cutting starting and cutting finishing end points are disposed inside the circumferential surface of the phantom cylinder.

18. A rotary-type sheet cutter according to claim 17, wherein the flat plate is bent toward the rotary axis (O) of the rotary blade along the first bend line (c).

19. A rotary-type sheet cutter according to claim 17, wherein at least a portion of a rear end edge of the rotary blade comprises a cut-off portion, and wherein the cut-off portion and the first bend line (c) form an angle (Θ) opening toward a cutting finishing side from the cutting starting side so that the rear end edge of the rotary blade does not interfere with the sheet material as the sheet material passes between said stationary and rotary blades.

20. A rotary-type sheet cutter according to claim 17, wherein at least a portion of a rear end edge of the rotary blade is bent along a second bend line (h) in a direction away from the rotary axis, and wherein the second bend line (h) and the first bend line (c) form an angle (Θ) opening toward a cutting finishing side from the cutting starting side so that the rear end edge of the rotary blade does not interfere with the sheet material as the sheet material passes between said stationary and rotary blades.

21. A rotary-type sheet cutter for cutting a continuous sheet material comprising:

a stationary blade having an end edge extending along a widthwise direction of the sheet material; and a rotary blade having an end edge portion which rotates about a rotary axis (O) extending along the widthwise direction of the sheet material during rotation of the rotary blade, the end edge portion of the rotary blade being provided with a tip plate having an end edge (k) intersection-contacting the end edge of the stationary blade under pressure so as to cut the sheet material along the widthwise direction when the rotary blade rotates, wherein:

the rotary blade comprises a flat plate bent along a first bend line (c), and the end edge (k) of the tip plate and the first bend line (c) form an angle (ϕ) opening toward a cutting starting side, and wherein a corner portion of the rotary blade at a cutting starting side is disposed so as to be the first portion of the rotary blade to contact the stationary blade when the rotary blade rotates, and wherein:

cutting starting and cutting finishing end points on the end edge of the rotary blade define two phantom end circles of a phantom cylinder as the rotary blade is rotated around the rotary axis, cutting starting and cutting finishing end points on the end edge of the stationary blade are on respective ones of the phantom end circles, a first angle is defined between the end edge of the rotary blade and a first imaginary line on the surface of the phantom cylinder, said first line being drawn parallel to the rotary axis, and a second angle is defined between the end edge of the stationary blade and a second imaginary line on the surface of the phantom cylinder, said second line being drawn parallel to the rotary axis, said first angle being less than said second angle, and intermediate portions of the rotary and stationary blades, respectively, between the cutting starting and cutting finishing end points are disposed inside the circumferential surface of the phantom cylinder.

22. A rotary-type sheet cutter according to claim 21, wherein the flat plate is bent toward the rotary axis (O) of the rotary blade along the first bend line (c).

23. A rotary-type sheet cutter according to claim 21, wherein at least a portion of a rear end edge of the rotary blade comprises a cut-off portion, and wherein the cut-off portion and the first bend line (c) form an angle (Θ) opening toward a cutting finishing side from the cutting starting side so that the rear end edge of the rotary blade does not interfere with the sheet material as the sheet material passes between said stationary and rotary blades.

24. A rotary-type sheet cutter according to claim 21, wherein at least a portion of a rear end edge of the rotary blade is bent along a second bend line (h) in a direction away from the rotary axis, and wherein the second bend line (h) and the first bend line (c) form an angle (Θ) opening toward a cutting finishing side from the cutting starting side so that the rear end edge of the rotary blade does not interfere with the sheet material as the sheet material passes between said stationary and rotary blades.

25. A rotary-type sheet cutter according to claim 4, wherein the second bend line (h) and the end edge of the rotary blade are substantially parallel.

26. A rotary-type sheet cutter according to claim 25, wherein the rear end edge is substantially parallel with the first bend line (c).

27. A rotary-type sheet cutter according to claim 3, wherein the rear end edge is substantially parallel with the first bend line (c).

28. A rotary-type sheet cutter according to claim 8, wherein the second bend line (h) and the end edge (k) of the tip plate are substantially parallel.

29. A rotary-type sheet cutter according to claim 28, wherein the rear end edge is substantially parallel with the first bend line. (c).

30. A rotary-type sheet cutter according to claim 7, wherein the rear end edge is substantially parallel with the first bend line (c).

31. A rotary-type sheet cutter according to claim 12, wherein the second bend line (h) and the end edge of the rotary blade are substantially parallel.

32. A rotary-type sheet cutter according to claim 31, wherein the rear end edge is substantially parallel with the first bend line (c).

33. A rotary-type sheet cutter according to claim 11, wherein the rear end edge is substantially parallel with the first bend line (c).

34. A rotary-type sheet cutter according to claim 16, wherein the second bend line (h) and the end edge (k) of the tip plate are substantially parallel.

35. A rotary-type sheet cutter according to claim 34, wherein the rear end edge is substantially parallel with the first bend line. (c).

36. A rotary-type sheet cutter according to claim 15, wherein the rear end edge is substantially parallel with the first bend line (c).

37. A rotary-type sheet cutter according to claim 20, wherein the second bend line (h) and the end edge of the rotary blade are substantially parallel.

38. A rotary-type sheet cutter according to claim 37, wherein the rear end edge is substantially parallel with the first bend line (c).

39. A rotary-type sheet cutter according to claim 19, wherein the rear end edge is substantially parallel with the first bend line (c).

40. A rotary-type sheet cutter according to claim 24, wherein the second bend line (h) and the end edge (k) of the tip plate are substantially parallel.

41. A rotary-type sheet cutter according to claim 40, wherein the rear end edge is substantially parallel with the first bend line. (c).

42. A rotary-type sheet cutter according to claim 23, wherein the rear end edge is substantially parallel with the first bend line (c).

43. A rotary-type sheet cutter according to claim 1, wherein said stationary blade and said rotary blade are positioned relative to each other so that, when said stationary blade and said rotary blade are viewed along the rotary axis (O) from a shearing end side of said blades, an appearance length (m) of said stationary blade is greater than an appearance length (n) of said rotary blade.

44. A rotary-type sheet cutter according to claim 5, wherein said stationary blade and said rotary blade are positioned relative to each other so that, when said stationary blade and said rotary blade are viewed along the rotary axis (O) from a shearing end side of said blades, an appearance length (m) of said stationary blade is greater than an appearance length (n) of said rotary blade.

45. A rotary-type sheet cutter according to claim 9, wherein said stationary blade and said rotary blade are positioned relative to each other so that, when said stationary blade and said rotary blade are viewed along the rotary axis (O) from a shearing end side of said blades, an appearance length (m) of said stationary blade is greater than an appearance length (n) of said rotary blade.

46. A rotary-type sheet cutter according to claim 13, wherein said stationary blade and said rotary blade are positioned relative to each other so that, when said stationary blade and said rotary blade are viewed along the rotary axis (O) from a shearing end side of said blades, an appearance length (m) of said stationary blade is greater than an appearance length (n) of said rotary blade.

47. A rotary-type sheet cutter according to claim 17, wherein said stationary blade and said rotary blade are positioned relative to each other so that, when said stationary blade and said rotary blade are viewed along the rotary axis (O) from a shearing end side of said blades, an appearance length (m) of said stationary blade is greater than an appearance length (n) of said rotary blade.

48. A rotary-type sheet cutter according to claim 21, wherein said stationary blade and said rotary blade are positioned relative to each other so that, when said stationary blade and said rotary blade are viewed along the rotary axis (O) from a shearing end side of said blades, an appearance length (m) of said stationary blade is greater than an appearance length (n) of said rotary blade.

* * * * *